US005507397A

United States Patent [19]

Bordignon et al.

[11] Patent Number: 5,507,397

[45] Date of Patent: Apr. 16, 1996

[54] DEVICE TO RETRIEVE AND DISCHARGE SHORT BARS

[75] Inventors: Giuseppe Bordignon, Bicinicco; Rolando Paolone, Buttrio; Ferruccio Tomat, Udine, all of Italy

[73] Assignee: Danieli & C. Officine Meccaniche SpA, Buttrio, Italy

[21] Appl. No.: 281,567

[22] Filed: Jul. 28, 1994

[30] Foreign Application Priority Data

Aug. 5, 1993 [IT] Italy ..... UD93A0156

[51] Int. Cl.[6] ..... B07C 5/14

[52] U.S. Cl. ..... 209/517; 209/521; 209/695

[58] Field of Search ..... 209/517, 518, 209/519, 521, 617, 656, 685, 695, 903, 904

[56] References Cited

U.S. PATENT DOCUMENTS

| | | | |
|---|---|---|---|
| 2,269,474 | 1/1942 | Nordquist | 209/904 X |
| 2,852,136 | 9/1958 | Peck | 209/521 |
| 2,867,323 | 1/1959 | Cook | 209/519 |
| 2,901,106 | 8/1959 | Aitken | 209/521 |
| 3,720,300 | 3/1973 | Rysti | 198/370 |
| 4,561,546 | 12/1985 | Maroney | 209/518 X |
| 4,919,273 | 4/1990 | Kruit et al. | 209/517 |

FOREIGN PATENT DOCUMENTS

| | | | |
|---|---|---|---|
| 1126527 | 11/1956 | France . | |
| 1448459 | 7/1970 | Germany . | |
| 763226 | 9/1980 | U.S.S.R. | 209/517 |
| 917869 | 4/1982 | U.S.S.R. | 209/517 |
| 1599290 | 9/1981 | United Kingdom . | |

*Primary Examiner*—William E. Terrell
*Assistant Examiner*—Tuan Nguyen
*Attorney, Agent, or Firm*—Antonelli, Terry, Stout & Kraus

[57] ABSTRACT

Device to retrieve and discharge short bars, which is associated with a counting and separation zone (16) of a bar feeder (12) upstream of a station for the formation of bundles of bars, the bars (11) being substantially butted at a first side of the device and being fed forwards in a direction perpendicular to their lengthwise extent, the bars (11) of a required length protruding at the second side of the device from their feeder (12), a retention device (19) to perform temporary retention being included in cooperation with the counting and separation zone (16) and with the second side of the device and defining an extraction station (15), which is equipped with a first plurality of separator/extractor rolls (27) within the bar feeder (12) and with a second plurality of extractor rolls (28) outside the bar feeder (12) and at the opposite side to the temporary retention device (19).

18 Claims, 2 Drawing Sheets

DEVICE TO RETRIEVE AND DISCHARGE SHORT BARS

BACKGROUND OF THE INVENTION

This invention concerns a device to retrieve and discharge short bars.

The bars with which the invention is concerned are rolled or drawn bars sheared to size, which are conveyed on a conveyor means to a packaging station.

The device to retrieve and discharge short bars according to the invention is employed in cooperation with bar feeder means such as conveyor chains, for instance, so as to retrieve and discharge, upstream of the counting and separation zone, the bars which have a length shorter than the nominal pre-set length.

The state of the art covers the problem of retrieving and discharging short bars included in a plurality of bars being fed parallel and side by side on a conveyor chain means in a direction perpendicular to the lengthwise extent of the bars.

The especially important requirement in this field is to be able to extract the short bars from the plurality of bars without affecting or slowing down the output.

This means that the extraction has to be carried out on each occasion without stopping the feed of the layer of bars and without occupying the extraction station for too much time, for otherwise that station would not be productive.

The short bars have to be removed when they do not meet the requirements of a pre-set length and do not fall within the limits of an accepted dimensional tolerance.

These too short bars are removed so as to ensure the formation of homogeneous bundles consisting of bars all of which have a minimum length that complies with the specified requirements.

The state of the art contains a solution whereby the short bars are removed during their forward feed on substantially horizontal conveyor chains by including at a given determined point in those conveyor chains a separation channel having its axis parallel to the axis of the bars being fed and therefore substantially perpendicular to the direction of feed of the bars.

Bridge-type supporting means are fitted at the separation channel and are spaced apart transversely and extend lengthwise so as to straddle the separation channel completely.

The transverse gap between the supporting means is such that the bars having a length greater than the required minimum rest with their ends on the supporting means, which are associated with chain means that ensure the onward feed of the bars.

The bars which do not reach the pre-set minimum length fall when they reach the separation channel since they are no longer upheld by the conveyor chains or by the supporting means.

This system entails the problem that the bars which have an adequate length but a thin cross-section and which are upheld only at their ends by the supporting means bend at their central portion and create problems when they should be cooperating with feeder means located downstream of the separation channel.

SUMMARY OF THE INVENTION

The present applicants have designed, tested and embodied this invention so as to overcome the shortcomings of the state of the art and to achieve further advantages.

The device to retrieve and discharge short bars according to the invention is pre-arranged to extract all the bars having a length shorter than a pre-set value.

The bars positioned parallel to each other and side by side on the conveyor plane are fed suitably spaced apart in a direction perpendicular to their lengthwise extent on a plurality of parallel chains.

All the bars being fed on the conveyor are to be deemed to have been actually butted against one side of the conveyor, as normally happens.

The bars are arranged in such a way that at least the bars having the required length jut out laterally at least by a given segment from the conveyor on the side opposite to the butting side.

According to the invention the extraction station includes a bar retention means at the side of the conveyor opposite to the butting side.

According to a first embodiment of the invention the retention means consists of at least one trolley able to move in the direction of feed of the bars at the same speed as the bars and comprising means to clamp temporarily the end of bars having the right length.

According to one lay-out of the invention the temporary clamping means consists of electromagnetic head means cooperating with clamping element means which can be momentarily actuated.

The trolley enters into cooperation with the bars in the extraction station and retains only those bars which meet the specified length requirements.

In particular, the temporary clamping means exert a retaining action on the jutting end of the bars and determine the positioning of the bars on the upper surface of the trolley.

The clamping element, where included, is equipped advantageously with a layer of resilient or substantially resilient or soft material on its face cooperating with the bars.

At least two trolleys are comprised advantageously to ensure continuity of the working cycle and to obviate the stoppage or slowing of output. One of these two trolleys is engaged in the working step while the other is in the step of returning to take up its starting position.

According to the invention a first plurality of threaded rolls is included in cooperation with the conveyor in the spaces defined by every two adjacent chains. The screw threads of these threaded rolls have a pitch coordinated with the speed of feed of the conveyor chains.

These threaded rolls located in cooperation with the conveyor perform a threefold action on the bars. A first action is to convey the bars in the direction of feed of the conveyor chains.

A second action is to distance the bar on which they are acting from the next bar, thus assisting extraction of the short bars without creating contact with the adjacent bars.

A third action is to extract sideways the short bars, namely the bars which are not retained by the temporary clamping means.

This sideway extraction action is effected by rotation of the threaded rolls in a direction inverted in relation to the position of the temporary clamping means.

A second plurality of electromagnetic rolls is included beside the conveyor on the side opposite to the position of the temporary clamping means and substantially on the axis of the first plurality of threaded rolls.

This second plurality of electromagnetic rolls has the task of removing the short extracted bars displaced even if only partly by the first plurality of threaded rolls.

At least some rolls of the second plurality of electromagnetic rolls have a screw-threaded surface conformation so as to displace the bars sideways.

This secondary plurality of screw-threaded rolls forms the roller conveyor discharging the short bars and cooperates at its downstream end with possible means that store and/or collect the short bars.

According to a variant the retention means according to the invention consists of a first rotary endless articulated conveyor means which includes a plurality of temporary clamping means associated with its upper surface.

These temporary clamping means may consist of electromagnetic heads which can be momentarily energised and disenergised and which cooperate with clamping means that are actuated momentarily against the bars to be retained laterally in the station where the short bars are extracted.

These electromagnetic heads are energised during the step of cooperation with the ends of the bars to be delivered to the counting zone and are then disenergised during their return travel to their starting position.

According to a further variant the bar retention means consists of a second endless articulated conveyor means, which in the extraction station cooperates above, and parallel to, the first endless articulated conveyor means by clamping the end of bars which are long enough to jut out laterally at least partly from the conveyor chains.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
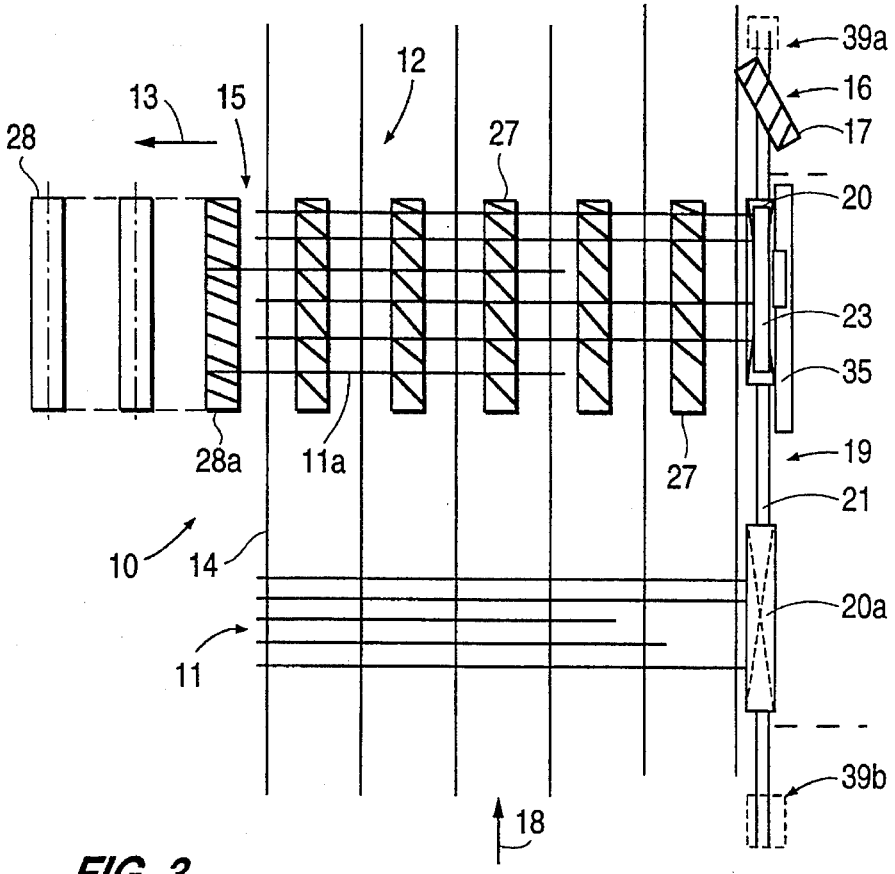
FIG. 1 is a plan diagram of a device to retrieve and discharge short bars according to the invention.

The reference number 10 in the attached figures denotes a device to retrieve and discharge short bars 11*a* according to the invention. This device 10 is applied to a conveyor 12 of bars 11 being fed substantially parallel and side by side in a direction 18 perpendicular to their lengthwise extent.

In this case the conveyor 12 consists of a plurality of parallel conveyor chains 14 spaced apart.

The bars 11 are fed side by side, parallel and substantially butted at one side on the chains 14.

At a station 15 for extraction of short bars 11*a*, which is positioned upstream of a counting zone 16 including a counting screw 17 in this case and on the opposite side to the bar 11 butting side, the device 10 comprises a bar retention means 19.

In the embodiment of FIG. 1 the bar retention means 19 includes a trolley 20, which moves on wheels 33 in guides 21, for instance, in a direction parallel to the conveyor chains 14 and in the same direction and at the same speed as the chains 14.

The trolley 20 bears an electromagnetic retention element 22 and at least one momentarily actuable clamping element 23.

In the extraction station 15, when the bar 11 is positioned by electromagnetic attraction on the electromagnetic retention element 22, the clamping element 23 is closed onto the bar 11 by rotation of a first arm 25 about a pivot 24.

Figure 3:
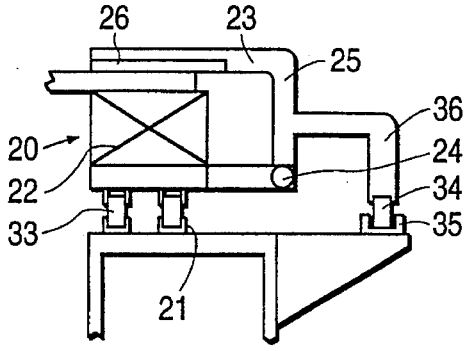
FIG. 3 is a front view of a possible form of embodiment of the movable trolley of the device of FIG. 1 in the clamped position.
Figure 4:
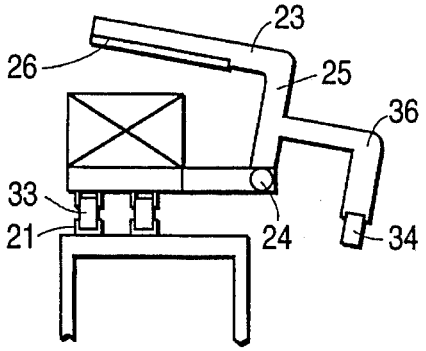
FIG. 4 is a front view of the trolley of FIG. 3 in the open position.

In the embodiment shown in FIGS. 3 and 4 this rotation is brought about when a wheel 34 comes into contact with a raised guide element 35 substantially in correspondence with the extraction station 15.

The wheel 34 is solidly fixed to a second arm 36 rigidly connected to the first arm 25 of the clamping element 23. Contact between the wheel 34 and the raised guide element 35 causes rotation of the first arm 25 from its closed position in FIG. 3 to its open position of FIG. 4; when contact between the wheel 34 and the raised guide element 35 has ended, the open position is obtained only by the weight of the first arm 25, which tends, unless it is resisted, to move naturally to the open position.

Figure 5:
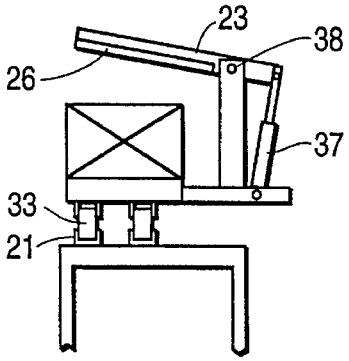
FIG. 5 shows a variant of the trolley of FIG. 4.

According to the variant of FIG. 5 the open and closed positions of the clamping element 23 are brought about by suitable actuators such as a piston 37, for instance, which causes the clamping element 23 to oscillate about a stationary pivot 38.

The clamping element 23 advantageously has a coating 26 of a soft material on its surface that cooperates with the bars 11.

In this way the bars 11 which meet the specified length requirements are held at one end in the extraction station 15 and continue advancing just the same on the conveyor chains 14 in the direction of feed 18.

The retention means 19 includes advantageously two or more movable trolleys 20 so as not to slow down the production cycle.

In the example of FIG. 1 the movable trolley 20*a* is in its inactive step and has its clamping element 23 in the open position.

The movable trolley 20 will cooperate with suitable descent 39*a* and ascent 39*b* stations in returning to the position of cooperation with the conveyor 12.

The device 10 includes a first plurality of screw-threaded rolls 27 at the extraction station 15 and in cooperation with the conveyor chains 14 and in the spaces between those chains 14.

The first threaded rolls 27, owing to the configuration of their threads, exert an action on the bars 11 both in the direction of feed 18 and in the direction of discharge 13 of the bars 11.

The first threaded rolls 27 cause also a distancing of one bar 11 from the next bar 11, thus making extraction easier and preventing any contact between a short bar 11*a* to be discharged and the adjacent bars.

The discharge action in a perpendicular direction 13 is only effective on short bars 11*a* which are not held laterally by the retention means 19.

Second electromagnetic discharge rolls 28 are included at the side of the conveyor 12 on the opposite side to the retention means 19 and are substantially parallel to the first threaded rolls 27.

At least the electromagnetic discharge roll 28*a* nearest to the conveyor 12 is advantageously screw-threaded.

The second discharge rolls 28 have the task of engaging and extracting the short bars 11*a* displaced even only partly by the first threaded rolls 27, thus assisting and ensuring discharge.

Figure 2:
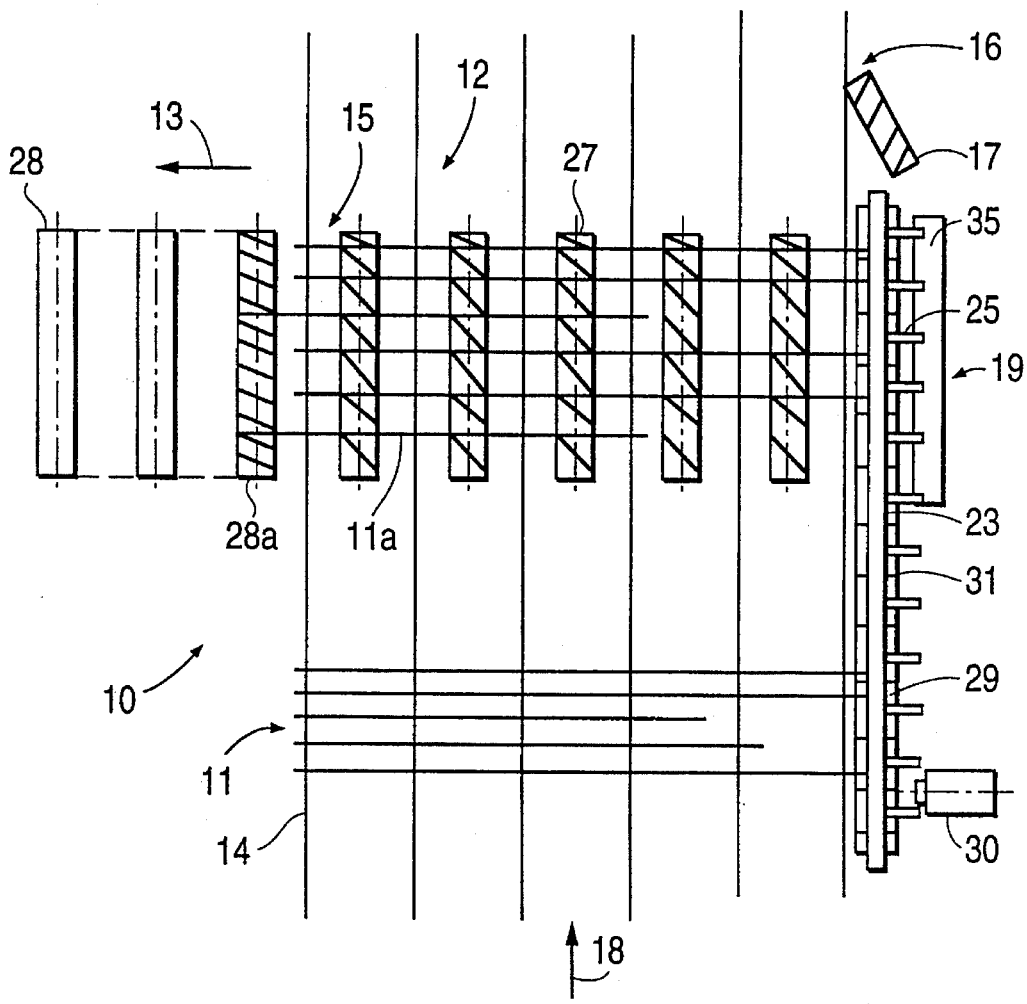
FIG. 2 is a plan diagram of a variant of the device of FIG. 1.

According to the variant of FIG. 2 the retention means 19 includes a first rotary endless articulated conveyor 29 which is driven by a motor 30.

Each element 31 of the first rotary endless articulated conveyor 29 is equipped with its own electromagnetic head of a type, for instance, momentarily energisable and cooperates in the extraction station 15 with clamping means 23, which are actuated in the extraction station 15 so as to clamp bars 11 which meet the specified length requirements.

In the example of FIG. 2 the clamping means 23 are actuated, in a manner substantially analogous to that of the trolley 20, by contact between the single first supporting arm 25 and the raised guide element 35 positioned so as to correspond with the extraction station 15.

Figure 6:
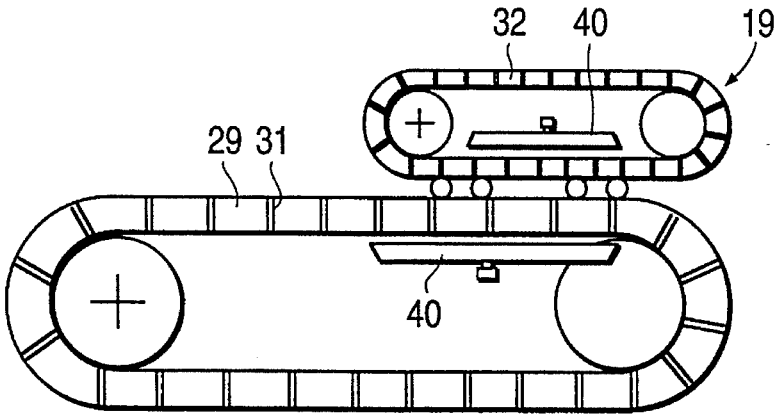
FIG. 6 shows another variant of the device of FIG. 1.

According to another variant shown in FIG. 6 the first rotary endless articulated conveyor 29 cooperates with a second overlying rotary endless articulated conveyor 32 positioned at the extraction station 15; this second articulated conveyor 32 in cooperation with the first rotary endless articulated conveyor 29 retains the bars 11 possessing the specified length requirements during the step of discharge of the short bars 11*a* performed by the first threaded rolls 27.

FIG. 6 shows electromagnetic energising means 40, which activate the electromagnetic heads on the first endless conveyor 29 only in correspondence with the extraction station 15.

We claim:

1. Device to retrieve and discharge short bars shorter than a predetermined length in a separation zone upstream of a station for the formation of bundles of bars, comprising a feeder for feeding the bars, the bars being substantially butted at a first side of the device and being fed forwards in a direction perpendicular to their lengthwise extent, the bars having at least the predetermined length protruding at a second side of the device from the feeder; a retention device for temporarily retaining bars having at least the predetermined length in said separation zone, said retention device being provided at the second side of the device and comprising at least one movable trolley and means to advance the at least one movable trolley at the same speed as, and beside, the feeder and an extraction station equipped with a first plurality of separator/extractor rolls within the feeder and a second plurality of extractor rolls outside the feeder and positioned at the first side of the device.

2. Device as in claims 1, in which the retention device includes an electromagnet for attracting the bars thereto.

3. Device as in claim 1, which includes a counting screw downstream of the extraction station.

4. Device as in claim 1, in which the first plurality of separator/extractor rolls comprises rolls having a circumferential screw-threaded profile with their direction of rotation inverted in relation to the position of the retention device.

5. Device as in claim 1, in which the second plurality of extractor rolls comprises an electromagnetic and has a direction of rotation inverted in relation to the position of the retention device.

6. Device as in claim 4, in which at least a part of the rolls of the second plurality of extractor rolls has a circumferential screw-threaded profile.

7. Device to retrieve and discharge short bars shorter than a predetermined length in a separation zone upstream of a station for the formation of bundles of bars, comprising a feeder for feeding the bars, the bars being substantially butted at a first side of the device and being fed forwards in a direction perpendicular to their lengthwise extent, the bars having at least the predetermined length protruding at a second side of the device from the feeder; a retention device for temporarily retaining bars having at least the predetermined length in said separation zone, said retention device being provided at the second side of the device and comprising a first rotary endless articulated conveyor and an extraction station equipped with a first plurality of separator/extractor rolls within the feeder and a second plurality of extractor rolls outside the feeder and positioned at the first side of the device.

8. Device as in claim 7, in which the retention device comprises a second overlying endless articulated conveyor with pressure means.

9. Device as in claims 7, in which the retention device includes an electromagnet for attracting the bars thereto.

10. Device as in claim 7, which includes a counting screw downstream of the extraction station.

11. Device as in claim 7, in which the first plurality of separator/extractor rolls comprises rolls having a circumferential screw-threaded profile with their direction of rotation inverted in relation to the position of the retention device.

12. Device as in claim 11, in which at least a part of the rolls of the second plurality of extractor rolls has a circumferential screw-threaded profile.

13. Device as in claim 7, in which the second plurality of extractor rolls comprises an electromagnetic and has a direction of rotation inverted in relation to the position of the retention device.

14. Device to retrieve and discharge short bars shorter than a predetermined length in a separation zone upstream of a station for the formation of bundles of bars, comprising a feeder for feeding the bars, the bars being substantially butted at a first side of the device and being fed forwards in a direction perpendicular to their lengthwise extent, the bars having at least the predetermined length protruding at a second side of the device from the feeder; a retention device for temporarily retaining bars having at least the predetermined length in said separation zone, said retention device being provided at the second side of the device and comprises in its upper portion a momentarily actuable clamping element and an extraction station equipped with a first plurality of separator/extractor rolls within the feeder and a second plurality of extractor rolls outside the feeder and positioned at the first side of the device.

15. Device as in claim 14, which includes a counting screw downstream of the extraction station.

16. Device as in claim 14, in which the first plurality of separator/extractor rolls comprises rolls having a circumferential screw-threaded profile with their direction of rotation inverted in relation to the position of the retention device.

17. Device as in claim 16, in which at least a part of the rolls of the second plurality of extractor rolls has a circumferential screw-threaded profile.

18. Device as in claim 14, in which the second plurality of extractor rolls comprises an electromagnetic and has a direction of rotation inverted in relation to the position of the retention device.

* * * * *